US011441872B2

(12) United States Patent
Balgaard

(10) Patent No.: US 11,441,872 B2
(45) Date of Patent: Sep. 13, 2022

(54) ADJUSTABLE ROTATING STOCK BUTT AND SIGHTING DEVICE

(71) Applicant: Stanley James Balgaard, Evansville, MN (US)

(72) Inventor: Stanley James Balgaard, Evansville, MN (US)

(73) Assignee: Stanley Balgaard, Evansville, MN (US)

( * ) Notice: Subject to any disclaimer, the term of this patent is extended or adjusted under 35 U.S.C. 154(b) by 0 days.

(21) Appl. No.: 16/748,045

(22) Filed: Jan. 21, 2020

(65) Prior Publication Data

US 2020/0158469 A1 May 21, 2020

Related U.S. Application Data

(63) Continuation-in-part of application No. 15/731,720, filed on Jul. 24, 2017, now Pat. No. 10,591,242.

(51) Int. Cl.

| | |
|---|---|
| ***F41G 1/02*** | (2006.01) |
| ***F41G 1/42*** | (2006.01) |
| ***F41G 1/22*** | (2006.01) |
| ***F41C 23/20*** | (2006.01) |

(52) U.S. Cl.

CPC ..... *F41G 1/02* (2013.01); *F41C 23/20* (2013.01); *F41G 1/22* (2013.01); *F41G 1/425* (2013.01)

(58) Field of Classification Search

CPC .... F41G 11/004; F41G 11/005; F41G 11/008; F41G 11/007; F41G 11/006

USPC ..... 42/111, 124, 125, 127

See application file for complete search history.

(56) References Cited

U.S. PATENT DOCUMENTS

| | | | | |
|---|---|---|---|---|
| 1,683,106 | A * | 9/1928 | Schrank | F41G 1/473 42/111 |
| 3,886,667 | A * | 6/1975 | Rueb | F41G 1/473 42/141 |
| 4,790,075 | A * | 12/1988 | Howard, Sr. | F41G 1/16 42/130 |
| 4,859,058 | A * | 8/1989 | Ekstrand | F41A 35/06 42/113 |
| 5,724,761 | A * | 3/1998 | Bergacker | F41G 1/345 42/123 |
| 6,421,946 | B1 * | 7/2002 | LoRocco | F41G 1/16 42/145 |
| 6,568,119 | B2 * | 5/2003 | Schoemaker | F41G 1/02 42/134 |
| 6,598,331 | B1 * | 7/2003 | Thibodeaux | F41G 1/52 42/111 |
| 2003/0009925 | A1 * | 1/2003 | Schoemaker | F41G 1/02 42/132 |

* cited by examiner

*Primary Examiner* — John Cooper

(57) ABSTRACT

A novel and improved rotating stock butt and rotating sight apparatus that applies to a shoulder fired firearm where the firing mechanism and the sight apparatus is elevated above the stock butt when in a horizontal shooting position. This system comprises a cooperation between the rotating stock butt and the rotating sight apparatus that allows the firing mechanism and the barrel of the firearm to be off set to either the right or to the left of the stock butt while the sight of the rotating sight apparatus can be rotated and secured at the top center of the firearm barrel, allowing the shooter minimal head movement in the gun mount.

8 Claims, 11 Drawing Sheets

ADJUSTABLE ROTATING STOCK BUTT AND SIGHTING DEVICE

BACKGROUND OF INVENTION

A. Field of Invention

The invention pertains to shoulder fired firearms in general and to a new and improved way of rotating the stock butt and the sight device to obtain a better fit in the gun mount.

B. Description of Related Art

Previously, there has never been a rotation of a stock butt and a sight device which allow for an offset of the firing mechanism and the barrel of the firearm to either the left or to the right of the stock butt permitting the shooter to align the eye with a sight device using minimal head movement in the gun mount.

BRIEF SUMMARY OF THE INVENTION

A rotating stock butt system, comprising an internal aligning tube which becomes the access point the stock butt rotates about; a narrowing of the cheek weld between the grip and the shoulder recoil pad configured in a fin like design; a series of spacers which shorten or lengthen the stock butt and also provide a locking means that when tightened secures the stock butt in a selected position, which prohibits the stock butt from rotating; a series of rotating sights that rotate around the firearm barrel; a rotating stock butt and rotating sight device, when secured, are configured to cooperate together to assure the sight always remains top center of the firearm barrel giving equal advantage to both right and left handed shooters, allowing minimal head movement in the gun mount to align the gun with the sight.

DETAILED DESCRIPTION OF DRAWINGS

FIG. 1

Figure 1:
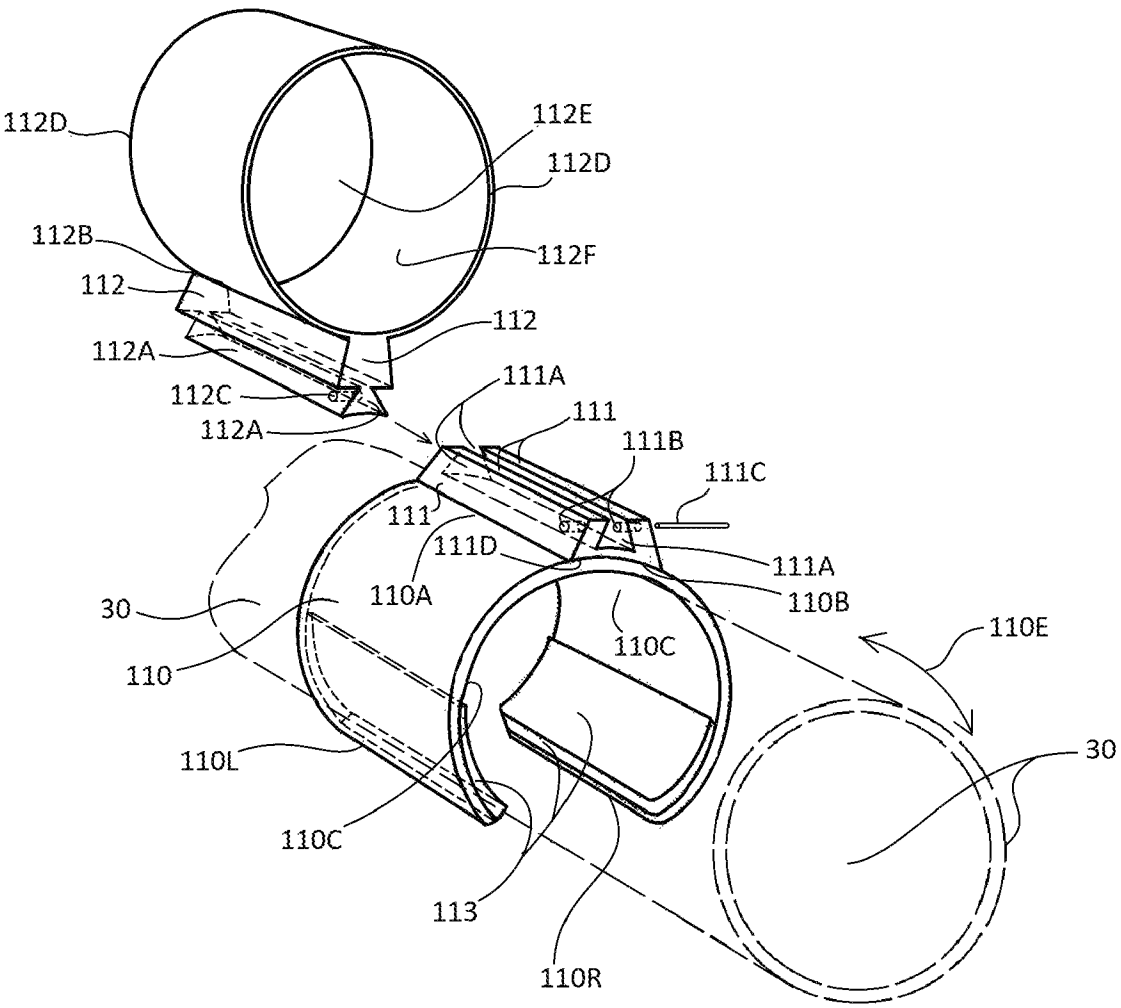
FIG. 1: Side quartering view of the rotating sight apparatus.
Figure 2:
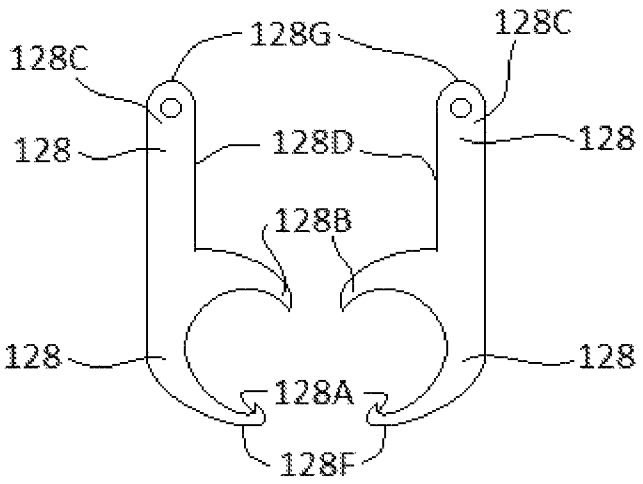
FIG. 2: Side view of a pair of elongated levers to be used to rotate the band clamp (not shown).

Side quartering view of the rotating sight apparatus.

Barrel (30) shown in broken lines.

Band clamp (110) circumferences partially shown barrel (30).

The upper surface (110A) of the band clamp (110) is linked to the lower surface (110B) of the support member (111).

A central configured opening (111A) in the support member (111) houses the lower configured portion (112A) of the sight support member (112).

The upper portion (112B) of the sight support member (112) can be molded to accommodate a series of sight configurations such as this hoop sight (112D).

Hoop sight (112D) has a shot viewing central opening (112E).

The surface of the inner circumference (112F) of the hoop sight (112D).

Openings (111B) and (112C) allow pin (111C) to pass through these openings and secure the sight support member (112) and the lower configured portion (112A) housed within the opening (111A) of the support member (111).

Rotation prohibiting pads (113) are secured to the inside surface (110C) of the band clamp (110) at the first opposing end (110R) and the second opposing end (110L) of the band clamp (110).

FIG. 2

Side view of a pair of elongated levers to be used to rotate the band clamp (not shown).

The elongated lever (128) has a hook (128A) at the first end (128F) on the first opposing side (128D).

A protuberance (128B) extends outward from the first opposing side (128D) of the elongated lever (128).

A grip (128C) extends to the second opposing end (128G) of the elongated lever (128).

In use, the elongated levers work in pairs. The elongated levers (128) align substantially parallel with each other. The first opposing sides (128D) face inward. The hooks (128A) grasp the first and second opposing ends (110L) and (110R) of the band clamp (110). The protuberances (128B) are placed against the upper surface (110A) of the band clamp (110). When opposing pressure is applied to the grips (128C) of the elongated levers (128) the protuberances (128B) apply inward pressure to the band clamp (110) at the upper surface (110A) of the band clamp (110). The hooks (128A) apply outward pressure to the first and second ends (110L) and (110R) opening the band clamp (110) releasing the rotation prohibiting pads (113) allowing the rotating sight apparatus to rotate to a selected position. When pressure is released from the grip (128C) of the band clamp (128) the band clamp tightens around the barrel (102B) of the shoulder fired firearm and the rotation prohibiting pad (113) secures the rotating sight apparatus in a selected stationary position.

FIG. 3

Side view of firing mechanism of shoulder fired firearm and the rotating stock butt; barrel and forearm partially shown.

Firearm barrel (30) shown in part.

A brake pad (100) has a forward leading side (LUF) and a rearward trailing side (100R).

The forward leading side (100F) is placed against the rearward trailing end (102R) of the firing mechanism (20).

At least one opening (100C) passes through the rotation prohibiting brake pad (100).

A threaded fastener (103) passes through the opening: (100C) in the rotation prohibiting brake pad (100) and fastens into a threaded opening (102G) in the rearward trailing end (102R) of the firing mechanism (20).

Fastener (103) secures the rotation prohibiting brake pad (100) to the rearward trailing end (102R) of the firing mechanism (20).

The rearward trailing side (100R) of the rotation prohibiting brake pad (100) is placed against the forward leading end (104F) of the rotating stock butt (104).

A central opening (100CO) in the rotation prohibiting brake pad (100) and a central opening (106) in the rotating stock butt (104) house the action spring tube (102C).

An elongated fastener (105) is threaded at the first end (102E) and fastens into the threaded opening (102E) at the rearward trailing end (102D) of the action spring tube (106).

An elongated fastener (105) has a tightening means at the second end (105A).

When the elongated threaded fastener (105) is tightened into the threaded opening (102E) in the rearward trailing end (102D) of the action spring tube (106) the tightening means at the second end of the elongated fastener (105) tightens against the rearward trailing end of the stock butt (104R) tightening the forward leading end (104F) of the rotating stock butt (104) against the rearward trailing side (100R) of the brake pad (100) securing the rotating stock butt (104) in a selected position.

When fastener (105) is loosened the rotating stock butt (104) can be rotated to another selected position.

The rearward trailing end of the trigger mechanism (102A).

FIG. 4

Slightly quartering rear view of the brake pad.

Drawing explanation, see FIG. 1.

FIG. 5

Slight quartering side view of the cheek and jaw channel on either a rotating or a stationary stock butt; a rotating stock butt is shown here. The stock butt has been divided and separated to give greater clarity to the jaw and cheek channel.

The jaw and cheek channel (122) extend from the recoil pad (123) at the rearward trailing end (104R) of the rotating stock butt (104) to the grip (124) at the forward leading end (104F) of the rotating stock butt (104).

The jaw and cheek channel (122) begin substantially at the center (125) of the rotating stock butt (104) and narrows into a fin (126) as it extends to the top (127) of the cheek channel (122).

The jaw and cheek channel (122) allow the users eye to substantially align with the sight apparatus of the firearm with minimal head movement in the gun mount.

FIG. 6

Top view of the jaw and cheek socket showing the jaw and cheek channel on both the left and the right side of either a rotating or stationary stock butt.

Figure 3:
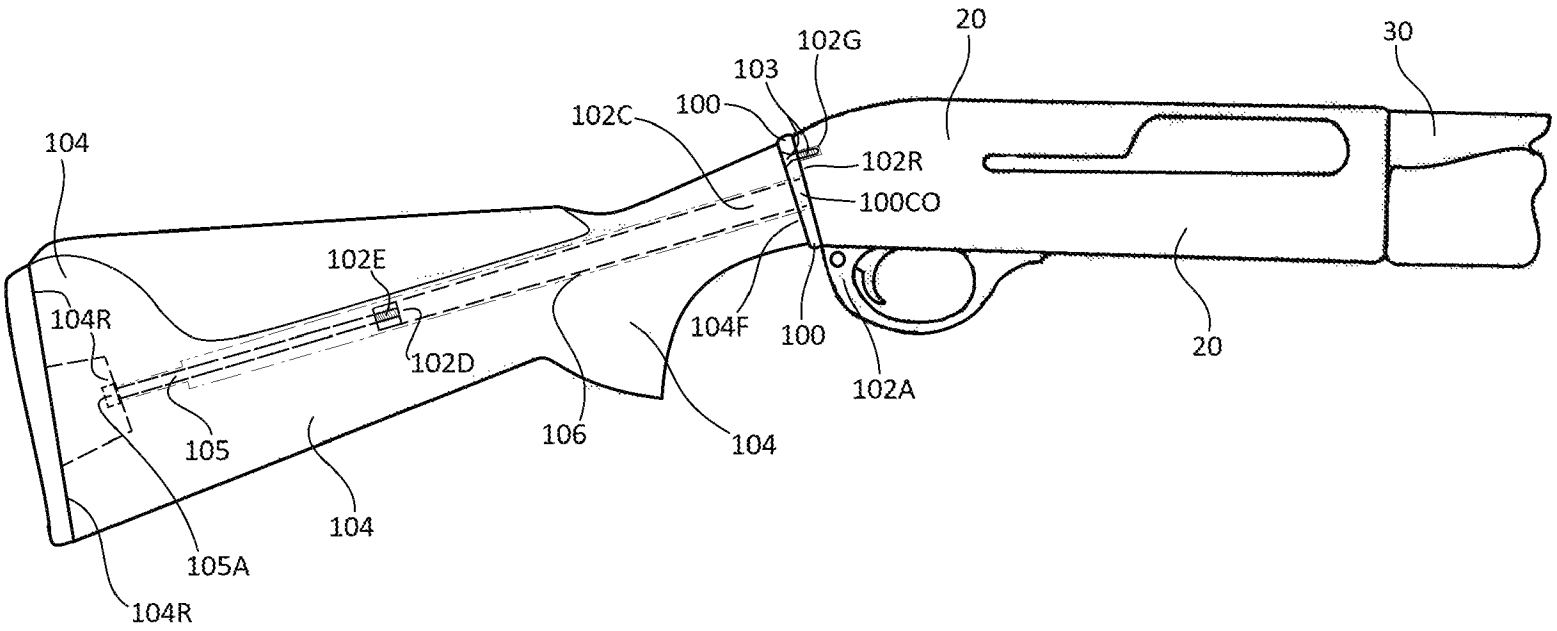
FIG. 3: Side view of firing mechanism of shoulder fired firearm and the rotating stock butt; barrel and forearm partially shown.
Figure 4:
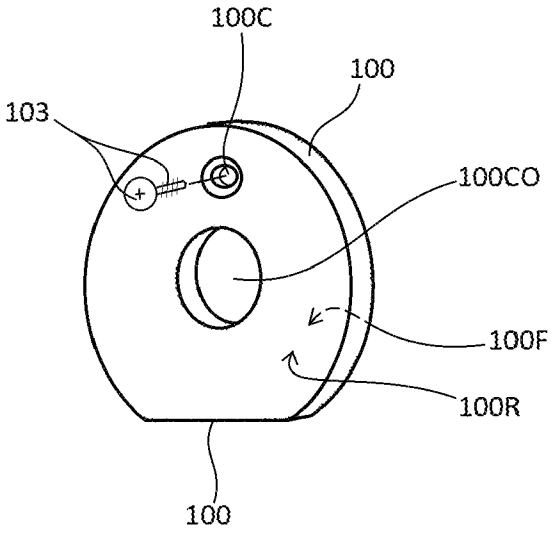
FIG. 4: Slightly quartering rear view of the brake pad.
Figure 5:
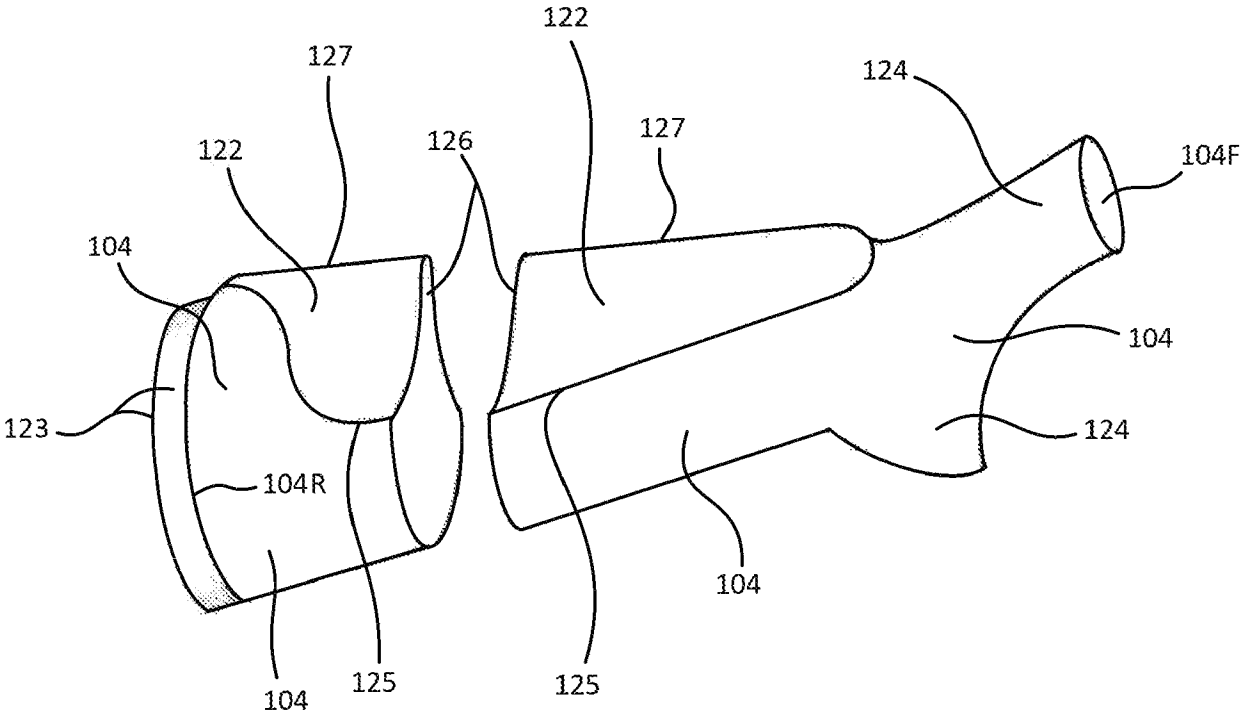
FIG. 5: Slight quartering side view of the cheek and jaw channel on either a rotating or a stationary stock butt; a rotating stock butt is shown here. The stock butt has been divided and separated to give greater clarity to the jaw and cheek channel.
Figure 6:
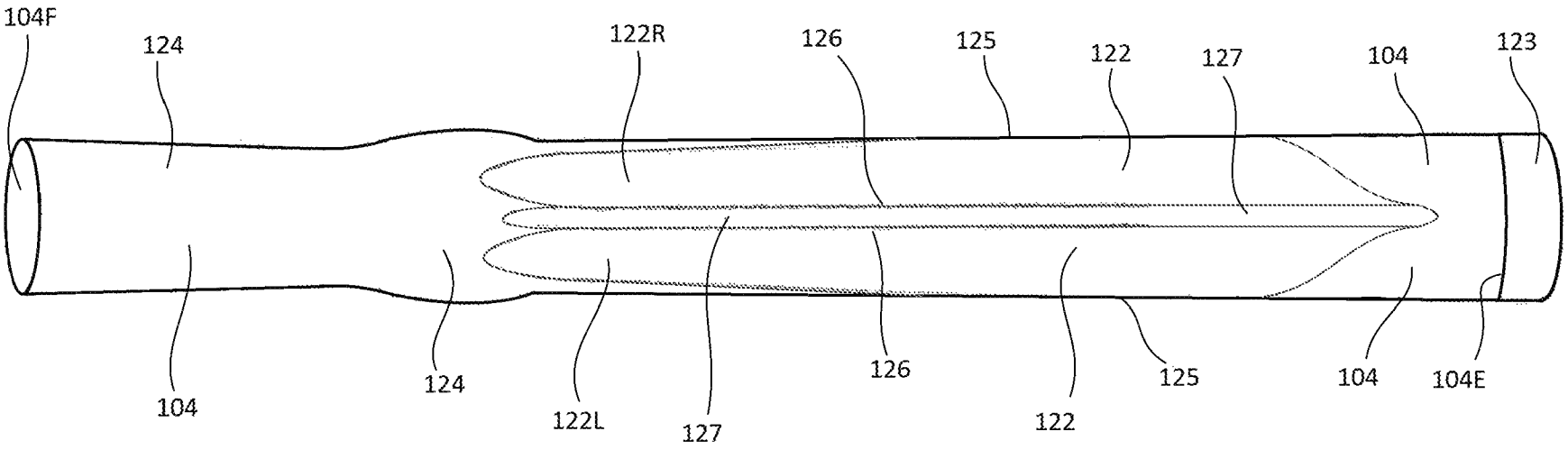
FIG. 6: Top view of the jaw and cheek socket showing the jaw and cheek channel on both the left and the right side of either a rotating or stationary stock butt.
Figure 7:
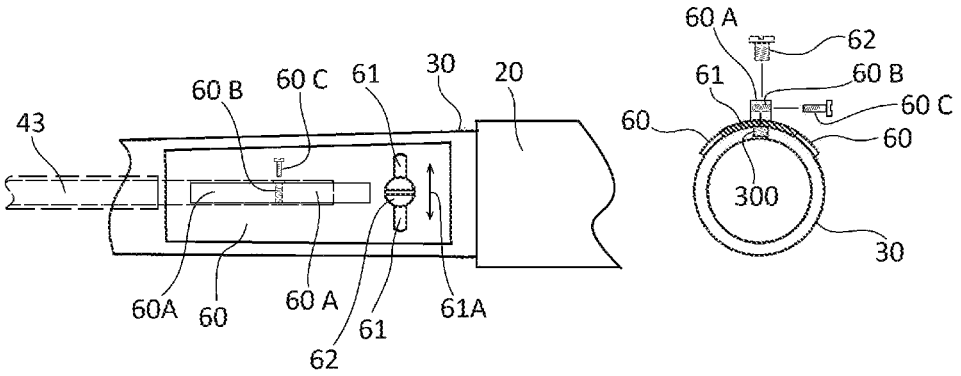
FIG. 7: A top and end view of the rear mounting base member.
Figure 8:
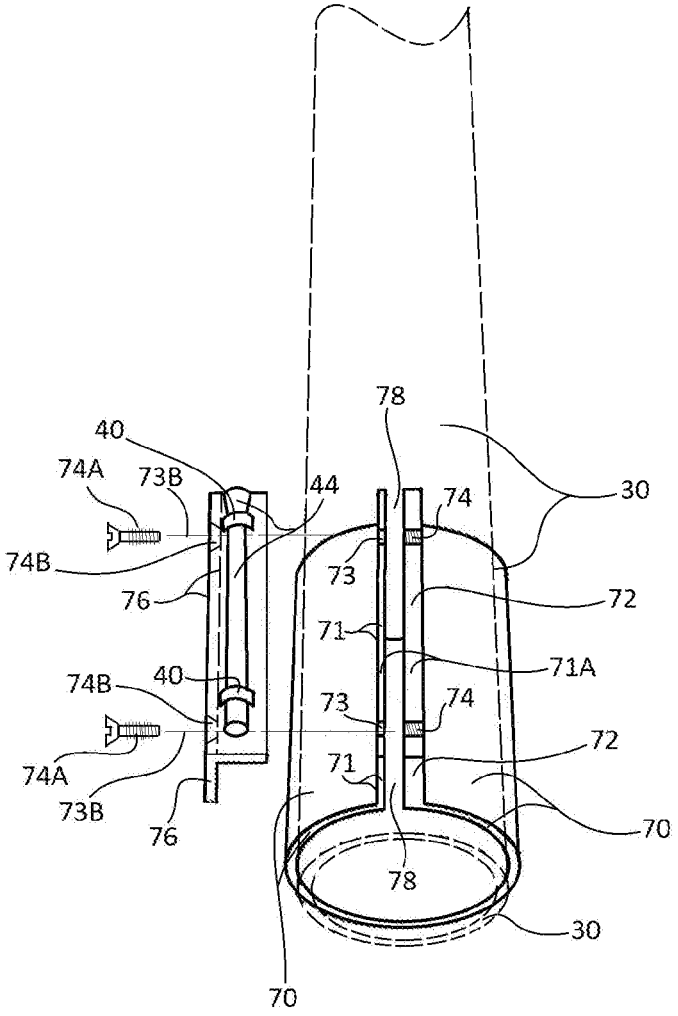
FIG. 8: A front quartering view of the tightening band and all of its components.
Figure 9:
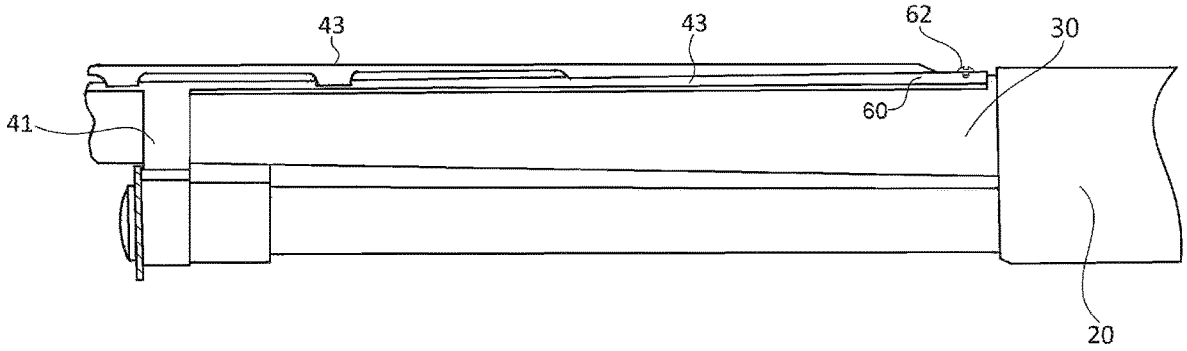
FIG. 9: Side view of the rear portion of the ventilated rib and the attaching members.
Figure 10:
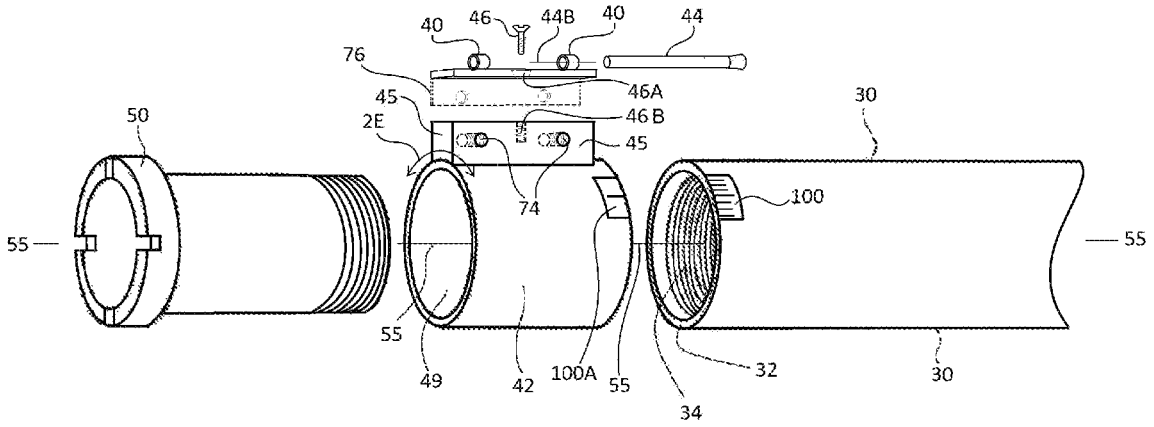
FIG. 10: Front quartering view of the rotating tube and its components.
Figure 11:
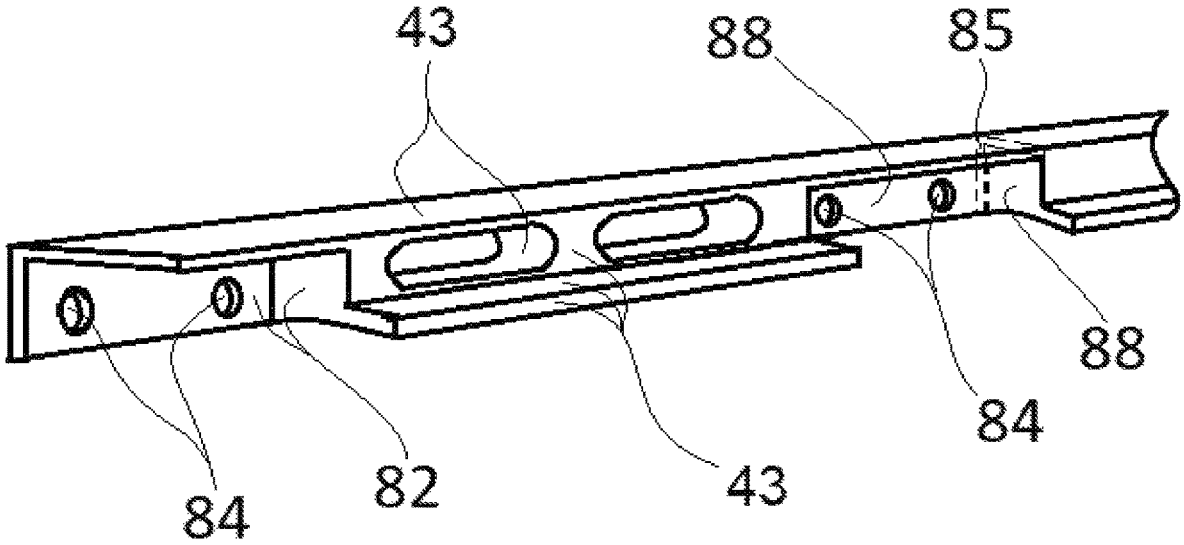
FIG. 11: Side front quartering view a section of a ventilated rib.

Drawing explanation, see FIG. 3.

FIG. 7

Atop and end view of the rear mounting base member.

The rear mounting base member (60) partially circumferences the barrel (30).

The rear mounting base member (60) has an elongated opening (61) that fastener (62) passes through and fastens into threaded opening (300). When fastener (62) is loosened, the rear mounting base member (60) can be partially rotated to either the left or the right, indicated by double-headed arrow (61A). When fastener (62) is tightened, it secures the rear mounting base member (60) in a selected position.

Second multiple sight apparatus mount (60A) is linked to the rear mounting base member (60).

A threaded opening (60B) passes through the second multiple sight apparatus mount (60A).

A threaded fastener (60C) passes through an opening in the ventilated sight rib (43) and threads into the threaded opening (60B) which secures the ventilated sight rib (43), shown in broken lines) to the second multiple sight apparatus mount (60A).

An opening (60B) in the second multiple sight apparatus mount (60A) provide means for different sighting beads (not shown) to be attached to the rear mounting base member (60).

FIG. 8

A front quartering view of the tightening band and all of its components.

Tightening band (70) houses the barrel (30).

A first member (71) and a second member (72) make up a third multiple sight apparatus mount (71A).

The first member (71) has openings (73); the second member (72) has threaded openings (74).

A sight apparatus (76) has openings (74B).

Openings (74B) in sight bead apparatus (76) and openings (73) in the first member (71) of the third multiple sight apparatus mount (71A) align with each other, indicated by line (73B), and allow fasteners (74A) to pass through openings and thread into the threaded openings (74) in the second member (72) In the third multiple sight apparatus mount (71A) indicated by line (73B).

Fasteners (74A), tighten into threaded openings (74) and fasten the sight apparatus (76) to the third multiple sight apparatus mount (71A). The gap (78) between the first member (71) and the second member (72) close together when fasteners (74A) are tightened into threaded openings (74) in the second member (72) of the third multiple sight apparatus mount (71A), tightening the tightening band (70) around the barrel (30).

Sight bead (44) is attached to the sight apparatus (76) by bands (40).

Bands (40) link to the sight bead apparatus (76).

FIG. 9

Side view of the rear portion of the ventilated rib and the attaching members,

Ventilated rib (43) extends to the rearward trailing end of the barrel (30) that links to rear mounting base member (60) and is held in place by fastener (62).

A band (41) or a tightening band (70) and its components, secure the central portion of the ventilated rib (43) to the central portion of the barrel (30) when the ventilated rib (43) extends from the forward leading end to the rearward trailing end of the barrel (30).

FIG. 10

Front quartering view of the rotating tube and its components.

Rotating tube (42) links to first multiple sight apparatus mount (45).

Threaded openings (74) pass through the first multiple sight apparatus mount (45).

Rotation degree markers (100 and 100A) may be rotated to the left or to the right, indicated by double-headed arrow (2E).

Fastener (46) travels through the opening (46A) in the sight bead apparatus (76) and threads into opening (468) in the first multiple sight apparatus mount (45).

The line of travel (448) of the sight bead (44) when inserted into the bands (40).

FIG. 11

Side front quartering view a section of a ventilated rib.

The cavities (82) and (88) of the ventilated rib (43) are configured to secure the first multiple sight apparatus mount (45) of the rotating tube (42) or the second multiple sight apparatus mount (60A) of the rear mounting base member (60) or the third multiple sight apparatus mount (71A) of the tightening band (70).

Fasteners of the tightening band (70), the rotating tube (42) and the rear mounting base member (60) pass through the openings (84) in the ventilated rib (43).

Broken lines (85) indicate the end of the ventilated rib (43) if the cavity (88) is mounted to the second multiple sight apparatus mount (60A) at the rear mounting base member (60).

The invention claimed is:

1. A firearm sight comprising:

a rotating sight apparatus, comprising:

a cylindrical body;

a sight apparatus comprising an upper surface and a lower surface;

a choke tube configured to be inserted at least partially into a firearm barrel, the choke tube comprising a portion configured to stay external to a firearm barrel, and having a raised shoulder on a forward end of the choke tube with an external diameter greater than an internal diameter of the firearm barrel;

wherein the cylindrical body is configured to be placed around an outside circumference of the choke tube, and the lower surface of the sight apparatus is attached to the cylindrical body and extends outward from the cylindrical body to the upper surface, the upper surface is configured to receive a sight; and wherein when the choke tube is loosened, the cylindrical body may be rotated to a selected position to place a sight in a user desired position, and when tightened, is configured to hold the cylindrical body in place between an end of a firearm barrel and the raised shoulder of the choke tube.

2. The firearm sight of claim 1 further comprising:

a sight riser;

the sight riser comprising a first upper and a second lower opposing side;

wherein the second lower side is configured to attach to the cylindrical body of the rotating sight apparatus;

wherein the first upper side extends upward a distance from the lower opposing side, and is configured to receive a sight.

3. The firearm sight of claim 1 further comprising:

a rotation degree marker;

the rotation degree marker comprising a first member attached to an end of a firearm barrel, and a second member attached to the cylindrical body, wherein the first and second members comprise marks indicating degrees of rotation, and the first and second members are located such that a relative rotation of the cylindrical body relative to the end of the firearm barrel is measured using the marks.

4. A firearm sight comprising:

a rotating sight apparatus, the rotating sight apparatus comprising:

a tightening band configured to wrap around an outer circumference of a firearm barrel;

first and second members that link to first and second ends of the tightening band;

at least one fastener;

a sight apparatus;

wherein the first and second members are substantially parallel with one another and a longitudinal axis of the barrel when installed; and wherein the first and second members protrude outward from the tightening band ends, forming a first and second side to each of the first and second members;

wherein the first member comprises at least one opening that passes from the first opposing side to the second opposing side;

wherein the second member comprises at least one aligned threaded opening;

wherein the sight apparatus is elongated from a first end to a second end and comprising an upper surface and a lower surface, wherein the lower surface comprises at least one aligned opening and the upper surface is configured to receive a sight;

wherein the tightening band is configured to create an open space formed between the first and second members when installed on a barrel, and wherein the sight apparatus is configured to be received within this open space;

wherein the at least one fastener is configured to pass through the at least one opening of the first member, through an aligned at least one opening of the sight apparatus, and thread into the at least one aligned threaded opening of the second member; and wherein tightening the fastener is configured to narrow the opening and tighten the tightening band around the outer circumference of the barrel, and securing the sight in a user selected rotational position, and loosening of the at least one fastener will allow a user to adjustably rotate the tightening band with the sight.

5. The firearm sight of claim 4 wherein:

a rotation prohibiting pad is configured with a first and second opposing sides and an outside peripheral edge;

the first opposing side is fastened to the inside surface of the tightening band;

the second opposing side is placed against the firearm barrel; and the rotation prohibiting pad prevents rotation of the rotating sight apparatus when the tightening band is tightened.

6. The firearm sight of claim 1 or 4 further comprising:

a hoop sight;

the hoop sight comprising a cylindrical body with a central opening, an inside surface, an outside surface, and a length extending from a forward end to a rearward end;

wherein the central opening is configured to be substantially the same diameter as the firearm barrel; and wherein the outside surface is configured to attach to the upper surface of the sight support apparatus; and is configured to be used as a sight.

7. The firearm sight of claim 1 or 4 further comprising:

a rear mounting base member comprising an elongated opening and a rear sight mount;

wherein the rear mounting base member is configured to at least partially circumference a firearm barrel and receive a fastener within the elongated opening, configured to secure the rear mounting base member in a desired rotational position when the fastener is tightened, and wherein the rear sight mount is configured to receive a rear sight.

8. A firearm sight comprising:

a rotating sight apparatus, comprising:

a cylindrical body;

a ventilated rib connected to the cylindrical body, the ventilated rib having a length extending in an opposing direction to a rear end, the length configured to extend down at least a portion of a firearm barrel;

a sight configured to be placed on an upper surface of the ventilated rib;

a rear mounting base member comprising an elongated opening and a rear sight mount;

a choke tube configured to be inserted at least partially into a firearm barrel, the choke tube comprising a portion configured to stay external to a firearm barrel, and having a raised shoulder on a forward end of the choke tube with an external diameter greater than an internal diameter of the firearm barrel;

wherein the cylindrical body is configured to be placed around an outside circumference of the choke tube;

wherein the rear mounting base member is configured to at least partially circumference a firearm barrel and receive a fastener within the elongated opening, configured to secure the rear mounting base member in a desired rotational position when the fastener is tightened, and wherein the rear mounting base member is configured to receive the rear end of the ventilated rib in the rear sight mount;

wherein when the choke tube and the rear mounting base member fastener are loosened, the cylindrical body, rear mounting base member, and ventilated rib may be rotated to a selected position to place the sight in a user desired position, and when tightened, is configured to hold the cylindrical body, rear mounting base member, and ventilated rib in a user desired rotational position.

* * * * *